US012484658B2

(12) United States Patent
Wei et al.

(10) Patent No.: US 12,484,658 B2
(45) Date of Patent: Dec. 2, 2025

(54) SUPPORT STRUCTURE FOR SHOE SOLES, SHOE SOLES AND SPORTS SHOES WITH THIS SUPPORT STRUCTURE

(71) Applicants: SANLIUYIDU (CHINA) CO., LTD., Fujian (CN); SANLIUYIDU (FUJIAN) SPORTS GOODS CO., LTD., Fujian (CN)

(72) Inventors: Shutao Wei, Fujian (CN); Tao Zhou, Fujian (CN); Siqi Liu, Fujian (CN); Yong Yan, Fujian (CN)

(73) Assignees: SANLIUYIDU (CHINA) CO., LTD., Quanzhou (CN); SANLIUYIDU (FUJIAN) SPORTS GOODS CO., LTD., Quanzhou (CN)

( * ) Notice: Subject to any disclaimer, the term of this patent is extended or adjusted under 35 U.S.C. 154(b) by 0 days.

(21) Appl. No.: 18/024,973

(22) PCT Filed: Jun. 30, 2022

(86) PCT No.: PCT/CN2022/102710
§ 371 (c)(1),
(2) Date: Mar. 7, 2023

(87) PCT Pub. No.: WO2023/226148
PCT Pub. Date: Nov. 30, 2023

(65) Prior Publication Data

US 2024/0277111 A1 Aug. 22, 2024

(30) Foreign Application Priority Data

May 23, 2022 (CN) ..... 202221247600.4

(51) Int. Cl.
*A43B 13/18* (2006.01)
*A43B 7/1425* (2022.01)
(Continued)

(52) U.S. Cl.
CPC ..... *A43B 13/186* (2013.01); *A43B 7/1425* (2013.01); *A43B 13/026* (2013.01); *A43B 13/127* (2013.01)

(58) Field of Classification Search
CPC ..... A43B 23/22; A43B 23/125; A43B 23/127; A43B 13/026; A43B 7/1415
See application file for complete search history.

(56) References Cited

U.S. PATENT DOCUMENTS 4,439,937 A * 4/1984 Daswick ..... A43B 13/10 36/72 A
4,794,707 A * 1/1989 Franklin ..... A43B 7/148 36/31
(Continued)

FOREIGN PATENT DOCUMENTS

CN 114343288 A 4/2022

*Primary Examiner* — Jillian K Pierorazio

(57) ABSTRACT

A support structure for a shoe sole includes a support piece with elasticity, the support piece is provided at the forefoot or/and arch position of the shoe sole and is laid out along the width direction of the shoe sole, the support piece is provided with a number of raised arc sections or/and concave arc sections along the width direction of the shoe sole. Shoe soles and athletic shoes include the support structure described above, the shoe sole support structure bonded or integrally molded to the upper surface of the shoe midsole, or bonded or integrally molded between the shoe midsole and the shoe outsole, or embedded inside the shoe midsole.

5 Claims, 8 Drawing Sheets

(51) Int. Cl.
*A43B 13/02* (2022.01)
*A43B 13/12* (2006.01)

(56) References Cited

U.S. PATENT DOCUMENTS 5,052,130 A * 10/1991 Barry ..... A43B 13/12 36/114
5,528,842 A * 6/1996 Ricci ..... A43B 21/30 36/38
6,038,790 A * 3/2000 Pyle ..... A43B 7/144 36/28
6,314,664 B1 * 11/2001 Kita ..... A43B 13/12 36/31
6,519,874 B1 * 2/2003 Dean ..... A43B 7/1445 36/43
7,200,955 B2 * 4/2007 Foxen ..... A43B 7/1445 36/31
2001/0032400 A1 * 10/2001 Brooks ..... A43B 23/22 36/102
2003/0000109 A1 * 1/2003 Kita ..... A43B 13/188 36/31
2007/0151124 A1 * 7/2007 Chan ..... A43B 7/1445 36/35 R
2008/0010863 A1 * 1/2008 Auger ..... A43D 8/00 36/103
2010/0307025 A1 * 12/2010 Truelsen ..... A43B 7/24 36/145
2011/0113656 A1 * 5/2011 Sato ..... A43B 7/1445 36/30 R
2016/0278476 A1 * 9/2016 Stien ..... A43B 7/20
2017/0119093 A1 * 5/2017 Grott ..... A43B 7/142
2017/0325543 A1 * 11/2017 Iuchi ..... A43B 13/186
2017/0347746 A1 * 12/2017 Van Bakel ..... A43B 7/1425
2019/0098959 A1 * 4/2019 Ma ..... A43B 13/187
2019/0289961 A1 * 9/2019 Iuchi ..... A43B 13/026
2020/0046068 A1 * 2/2020 Choi ..... B32B 5/22
2020/0305543 A1 * 10/2020 Kajiwara ..... A43B 13/023
2020/0390191 A1 * 12/2020 Foxen ..... A43B 13/14
2021/0227929 A1 * 7/2021 Ni ..... A43B 13/37
2021/0267306 A1 * 9/2021 Sakaguchi ..... A43B 13/14
2022/0104581 A1 * 4/2022 Sakaguchi ..... A43B 13/141
2022/0125158 A1 * 4/2022 Ni ..... A43B 13/026

* cited by examiner

SUPPORT STRUCTURE FOR SHOE SOLES, SHOE SOLES AND SPORTS SHOES WITH THIS SUPPORT STRUCTURE

TECHNICAL FIELD

The present utility model relates to the technical field of sports shoes, specifically a sole support structure and a sole thereof.

BACKGROUND ART

In order to obtain the best jump height and movement speed, the human body will fully collect motor units to improve the lower limb work capacity. The researchers replaced the midsole of the shoe with a shock absorbing material in order to avoid high impact loads during touchdown. Although shock-absorbing materials provide good protection, they also have the disadvantage of insufficient support and energy return. In the prior art, the midsole bending stiffness is usually increased at a smaller sacrifice of cushioning performance as a way to improve the support and energy return during movement.

The foot plays an important role in the longitudinal jumping process as the end link of the body in contact with the ground. The metatarsophalangeal joint, which is the second largest joint of the foot, is in a fully energy-absorbing dorsiflexion state during the process. Thus, the energy absorbed by the metatarsophalangeal joint is transferred to the shoe structure for storage and converted into body kinetic energy during the stirrup phase, becoming an effective way to improve longitudinal jump performance. Current industry shoe products cannot simultaneously meet the three functions of energy transfer from the metatarsophalangeal joint, good flexion of the metatarsophalangeal joint, and energy absorption during touchdown.

DESCRIPTION OF UTILITY MODEL

The purpose of the utility model is to provide a sole support structure and a sole thereof to achieve energy return performance of the sole and enhance the sports effect. In order to achieve the above purpose, the utility model adopts the following technical solutions:

The present utility model discloses a support structure for shoe soles, including a flexible support piece, the support piece is set in the forefoot or arch position of the shoe sole, and it is laid out along the width direction of the shoe sole, the support piece is set with a number of raised arc sections or/and concave arc sections along the width direction of the shoe sole.

Further, the support sheet is made of carbon fiber board or TPU board with hardness ≤0.261 Nm/deg.

Wherein the support piece is a raised arc section on both sides along the width direction of the sole and a flat surface in the middle; or a raised arc section on the inner side and a flat surface in the middle and outer side; or a raised arc section as a whole, or a raised arc section in the middle and a flat surface on both sides.

Wherein the support piece is a recessed arcuate section in the middle along the width direction of the sole, with flat surfaces on both sides.

Wherein, the support piece includes two pieces, and the two support pieces are distributed on both sides of the foot-plantar-toe joint line.

Preferably, it also includes a support plate located on the upper or lower surface of the support piece, the support plate being connected to the support piece.

In another embodiment, further comprising a support plate located below the support piece, the support plate being arranged along the length of the sole, the support plate being filled with elastic material between the support plate and the support piece.

Preferably, the upper surface of the support piece has a downward bending degree of a and the lower surface has an upward bending degree of b, then a>b.

The present utility model also discloses a shoe sole including the above-mentioned support structure which is bonded or integrally molded to the upper surface of the shoe midsole, or bonded or integrally molded between the shoe midsole and the shoe outsole, or embedded inside the shoe midsole.

Preferably, the support structure is placed on the upper surface of the shoe midsole, and the shoe midsole is provided with a bottom convex corresponding to the position of the raised arc section, or the shoe midsole is provided with a recess corresponding to the position of the lower concave arc section.

Further, the material of the bottom convex or grooved part is a high resilient EVA material with a resilience rate of 55-70%.

The present utility model also discloses a sports shoe including the above-mentioned sole.

As a result of the above structure, the utility model has the following beneficial effects:

1. The present utility model can convert the human kinetic energy in the touchdown and buffering stages into the elastic potential energy of the sole support structure, and convert the elastic potential energy into human kinetic energy again in the stirrup stage, thus facilitating bouncing and enhancing the sports effect.
2. The material of the support sheet is carbon fiber plate or TPU plate, making it have better elastic bending performance.
3. The upper surface of the utility model support sheet downward bending degree is greater than the lower surface upward bending degree, making it easier to bend downward, which is conducive to absorbing impact and increasing the effect of shock absorption and energy return.

DESCRIPTION OF THE MAIN COMPONENT SYMBOLS

1: support piece, 2: raised arc section, 3: flat surface, 4: lower concave arc section, 5: support plate, 6: shoe midsole, 7: bottom convexity, 8: recess.

EMBODIMENTS

In order to enable a person skilled in the art to better understand the technical solution of the utility model, the following is a further detailed description of the utility model in conjunction with the accompanying drawings and specific embodiments.

Embodiment 1

Figure 1:
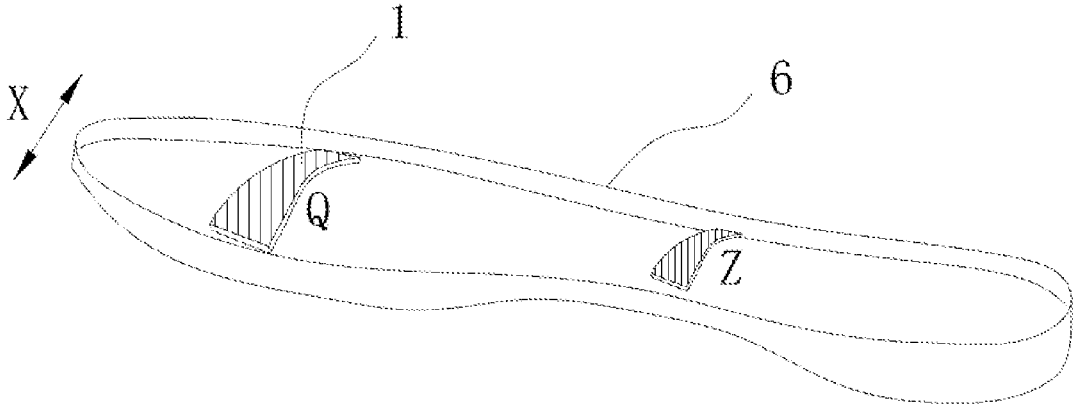
FIG. 1 is a schematic diagram of the installation structure of the support piece in Embodiment 1.

As shown in FIG. 1, this embodiment discloses a support structure for the sole of a shoe, including a flexible support piece 1, which is provided at the forefoot position (Q in FIG. 1) or the arch position (Z in FIG. 1) of the sole, or at both the forefoot and the arch position, and which is arranged along the width direction of the sole (X in FIG. 1).

In this embodiment, the support piece 1 is provided with a number of raised curved sections 2 that can undergo elastic deformation under force along the width direction of the sole.

Figure 2:
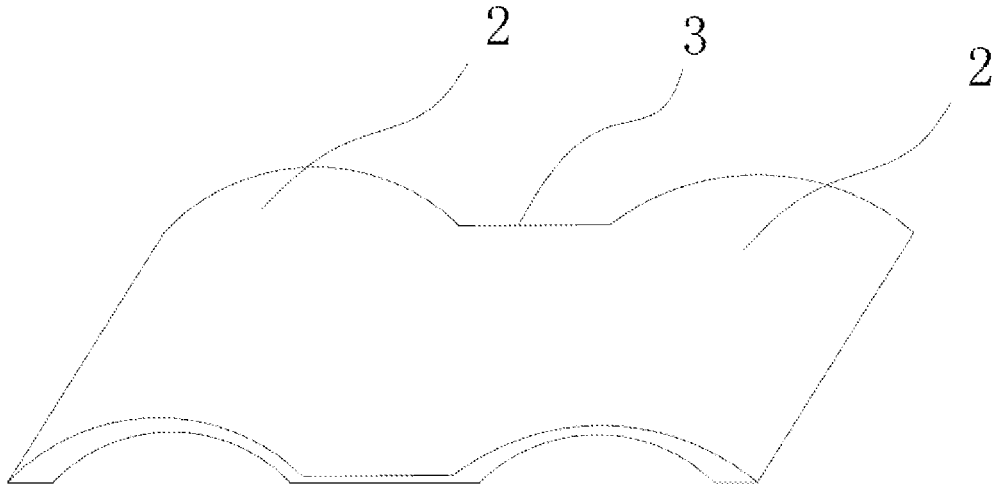
FIG. 2 is a schematic diagram of the structure of a support piece (with raised arc sections on both sides).
Figure 3:
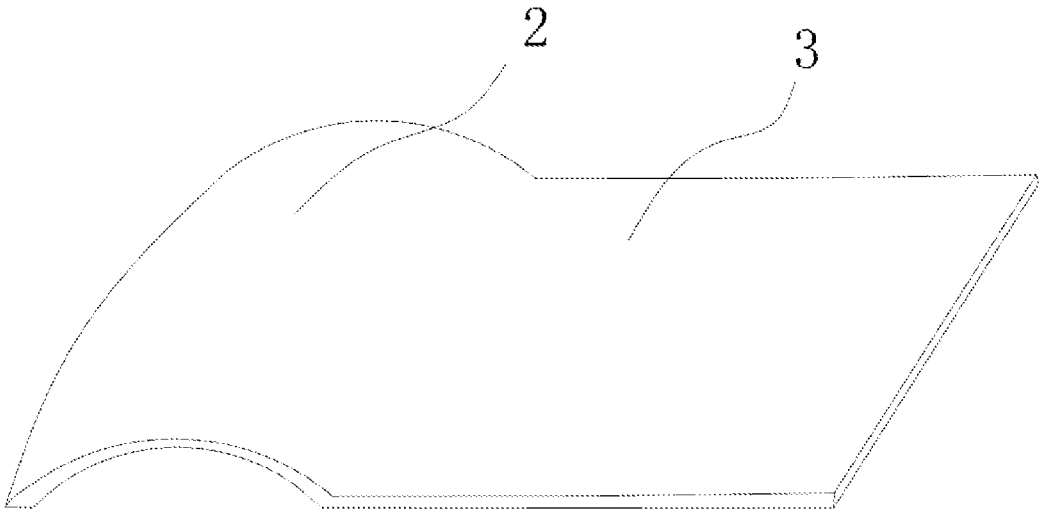
FIG. 3 is a schematic diagram of a structure of a support piece (with raised arc sections on the inner side)
Figure 4:
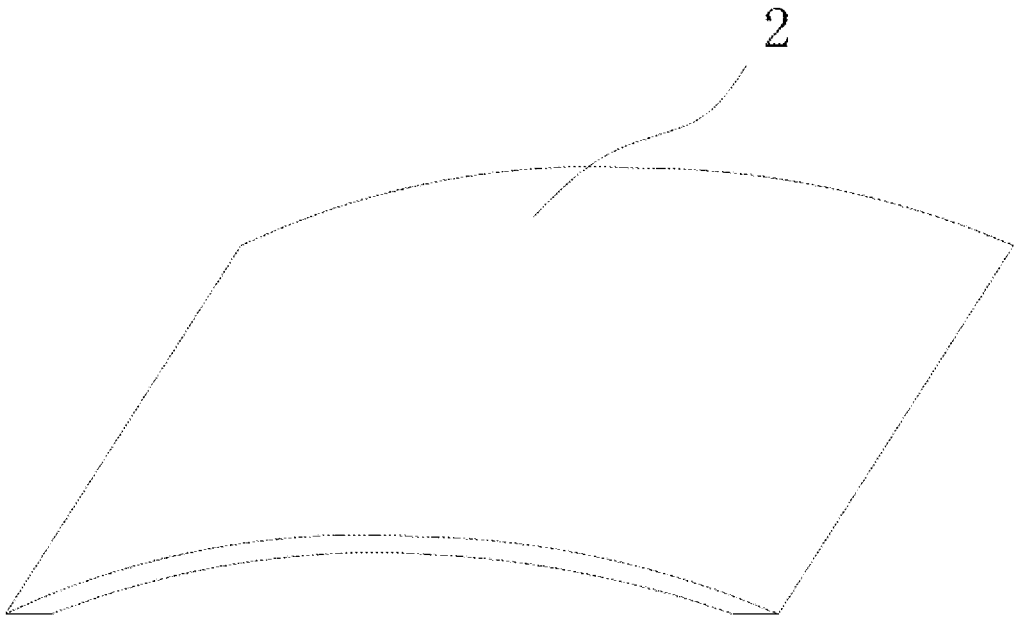
FIG. 4 is a schematic diagram of the structure of a support sheet (the whole is a raised curved section).
Figure 5:
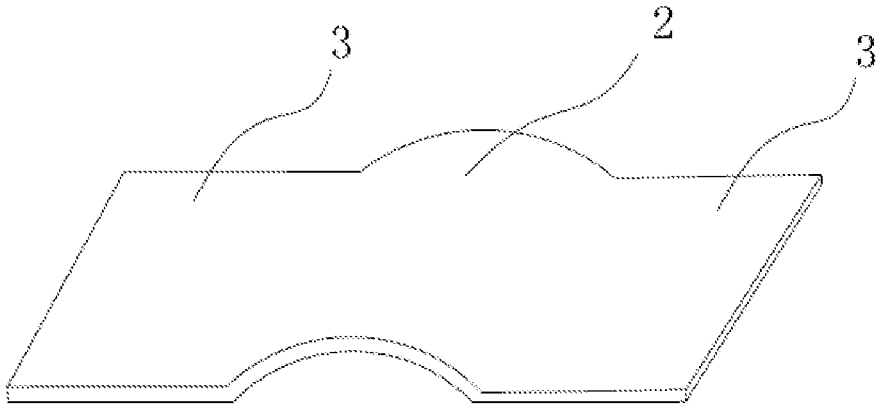
FIG. 5 is a schematic diagram of the structure of a support plate (with a raised curved section in the middle).

The number of raised arc sections 2 can be set one or more. As in FIG. 2, the support piece 1 is flanked by raised arcuate sections 2 along the width direction of the sole, with a flat surface 3 in the middle. In FIG. 3, the support piece 1 is a raised curved section 2 along the width of the sole on the inner side, and a flat surface 3 in the middle and outer side. When the shoe is a left-footed shoe, the width direction of the sole is on the inner side of the right side, and when the shoe is a right-footed shoe, the width direction of the sole is on the inner side of the left side. The overall of the support sheet 1 in FIG. 4 is a raised arcuate section 2 along the width direction of the sole. In FIG. 5, the middle of the support piece 1 along the width direction of the sole is a raised arc section 2, and the sides are flat 3.

Figure 6:
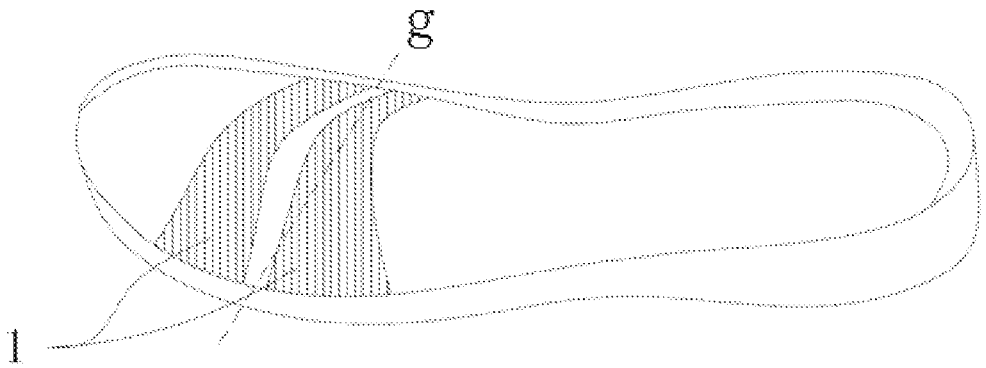
FIG. 6 is a schematic diagram of the structure with two support pieces.

The support piece 1 may comprise one or two pieces. As shown in FIG. 6, the two support pieces 1 are distributed on both sides of the metatarsophalangeal joint line g, which does not affect the bending stiffness at the metatarsophalangeal joint.

The material of the support sheet 1 is carbon fiber plate or TPU plate. There are different kinds of hardness of carbon fiber plate, in order to make the carbon fiber plate of this application more elastic, the hardness of carbon fiber≤0.261 Nm/deg is used. Carbon fiber plate material is more sensitive to force perception and faster response to deformation. Therefore, the use of this material can effectively solve the problem of slow energy return rate of existing materials and structures, so that the jumping action has been completed, but the absorbed energy is not fully released.

Embodiment 2

This embodiment discloses a support structure for a shoe sole, including a support piece 1 having elasticity, the support piece 1 is provided at the forefoot position of the shoe sole, and it is laid out along the width direction of the shoe sole, and it is provided with a number of under-concave arc-shaped sections 4 that can undergo elastic deformation by force along the width direction of the shoe sole.

Figure 7:
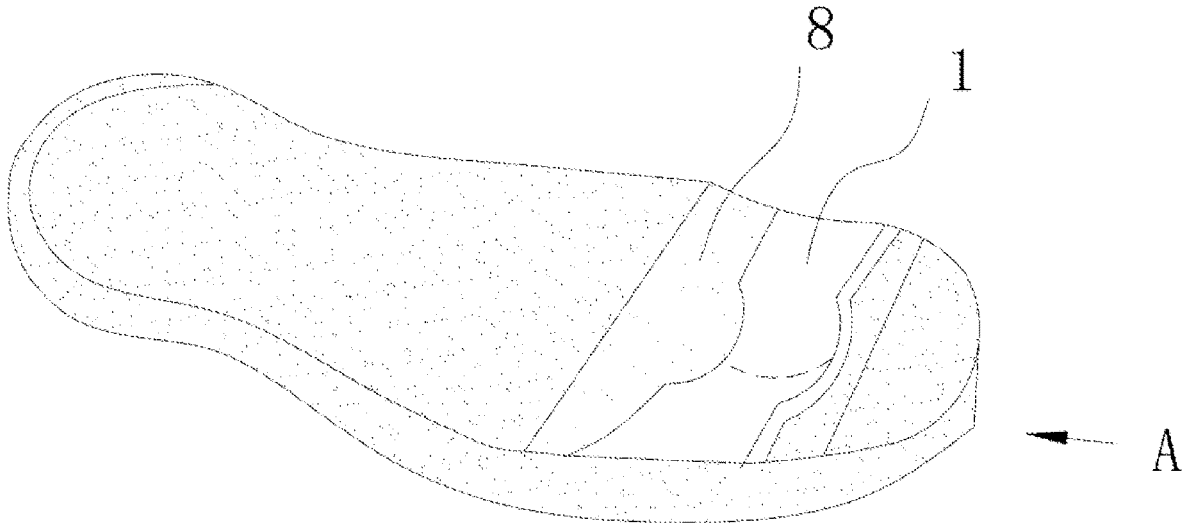
FIG. 7 is a schematic diagram of the structure of Embodiment 2 and Embodiment 7.
Figure 8:
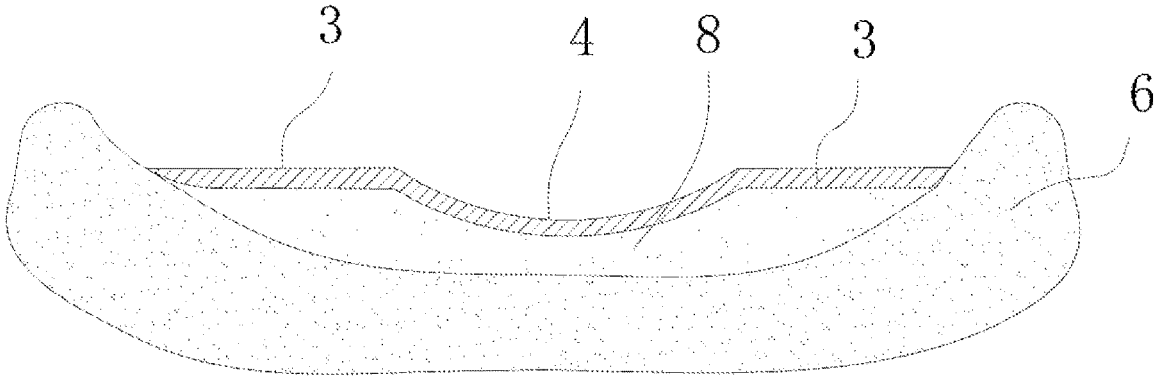
FIG. 8 is a sectional schematic diagram of the section along the middle of the support plate as viewed from A to 7.

As shown in FIGS. 7 and 8, the middle of the support piece 1 in this embodiment is a recessed arcuate section 4 along the width direction of the sole of the shoe, and the sides are flat 3.

Embodiment 3

Figure 9:
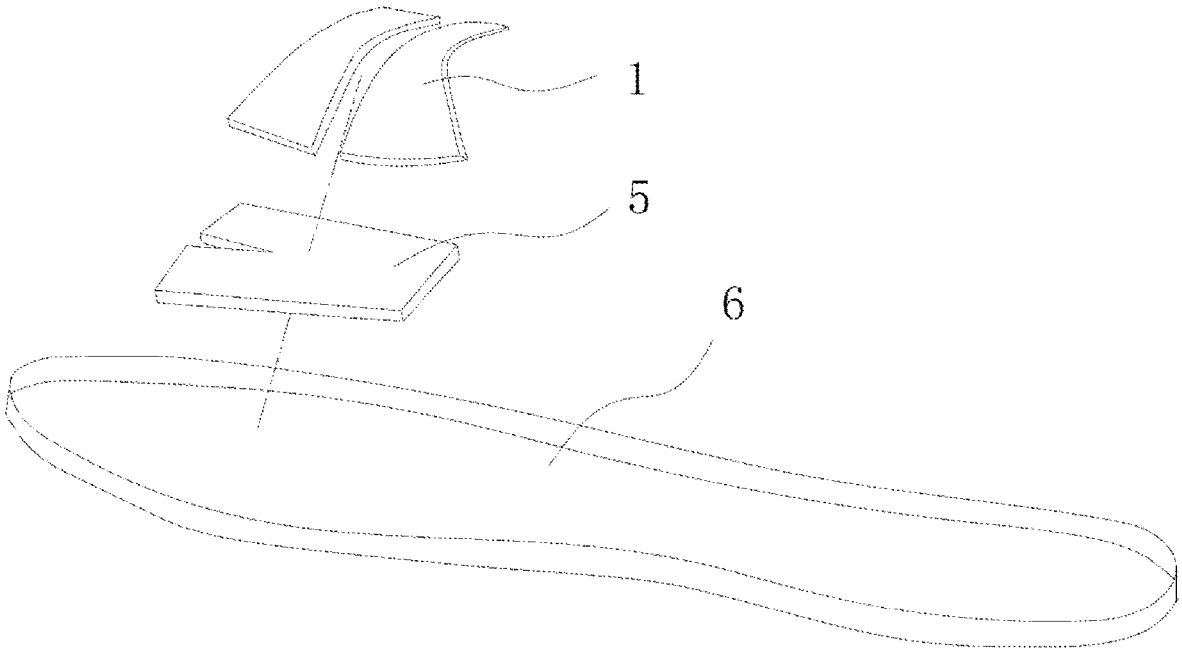
FIG. 9 is a schematic diagram of the decomposition of Embodiment 3.
Figure 10:
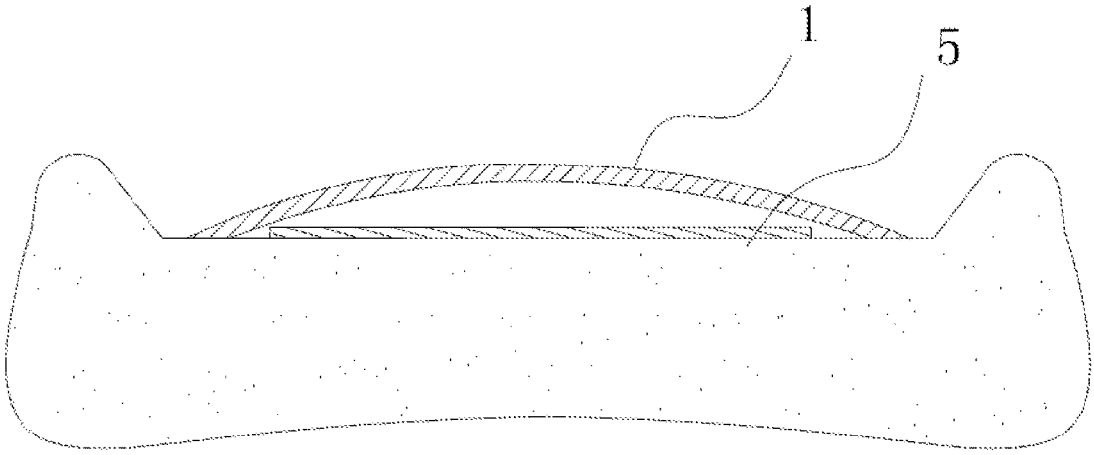
FIG. 10 is a schematic diagram of a cross-sectional view of a support plate fixed to the lower surface of the support sheet.
Figure 11:
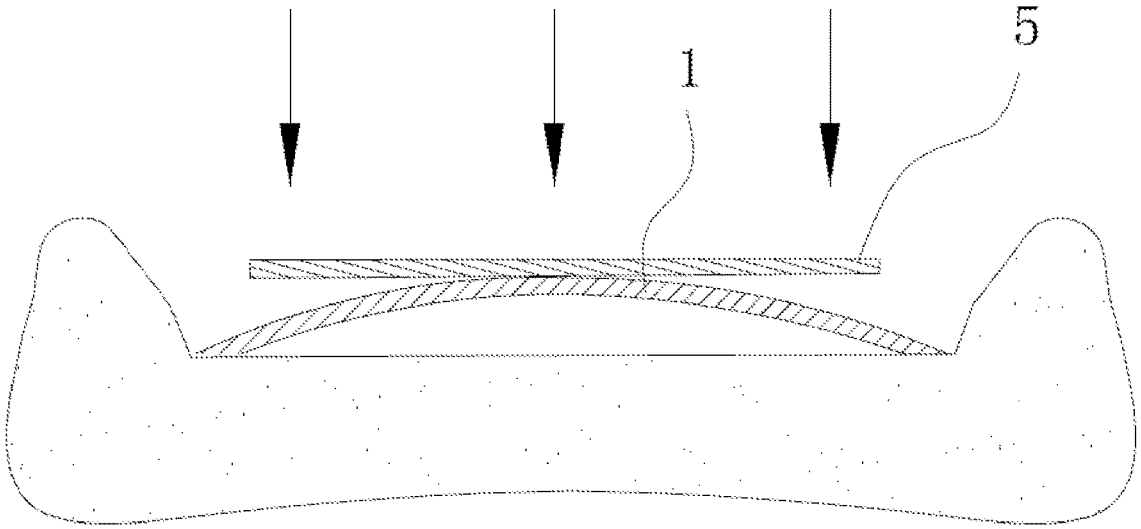
FIG. 11 is a schematic cross-sectional view of the support plate fixed to the upper surface of the support sheet.

As shown in FIG. 9, this embodiment discloses a support structure for a shoe sole, comprising a number of support sheets 1 having elasticity and a support plate 5 fixed to the lower or upper surface of the support sheet 1. In FIG. 10, the support plate 5 is fixed to the lower surface of the support piece 1. In FIG. 11, the support plate 5 is fixed to the upper surface of the support plate 1, the support plate 5 is set to make the stability better when stepping on the movement.

Embodiment 4

Figure 12:
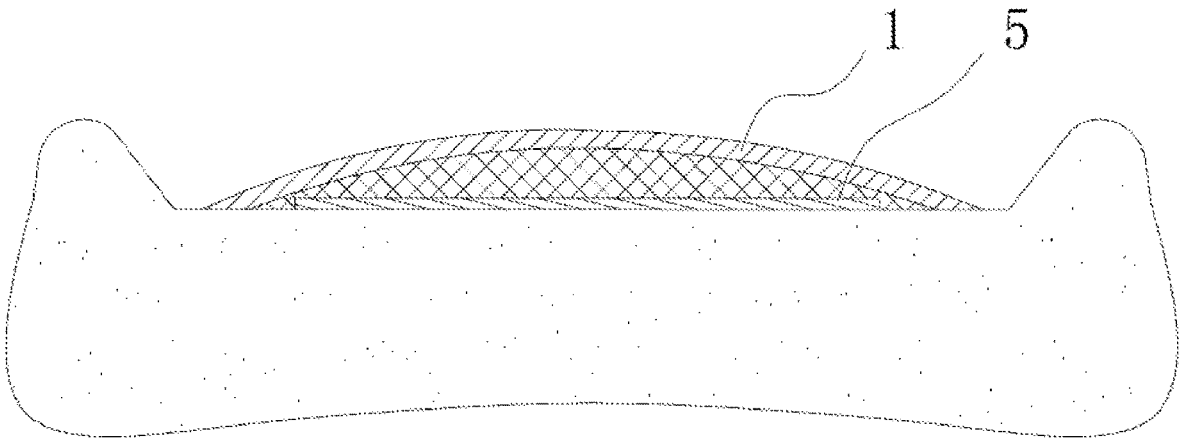
FIG. 12 is a cross-sectional schematic diagram of Embodiment 4.

As shown in FIG. 12, this embodiment discloses a support structure for a shoe sole, comprising a support sheet 1 having resilience and a support plate 5 disposed below the support sheet 1, the support plate 5 having a hardness greater than the hardness of the support sheet 1. The support plate 5 is laid out along the length of the sole, and the support plate 5 is filled with sole material (such as EVA material) between the support plate 5 and the support piece 1. The EVA material is filled to maintain the structure in a stable state during the work process, while carrying out secondary cushioning and energy return.

Embodiment 5

This embodiment discloses a shoe sole comprising the support structure of Embodiment 1. The sole support structure is bonded or integrated into the upper surface of the shoe midsole 6.

Figure 13:
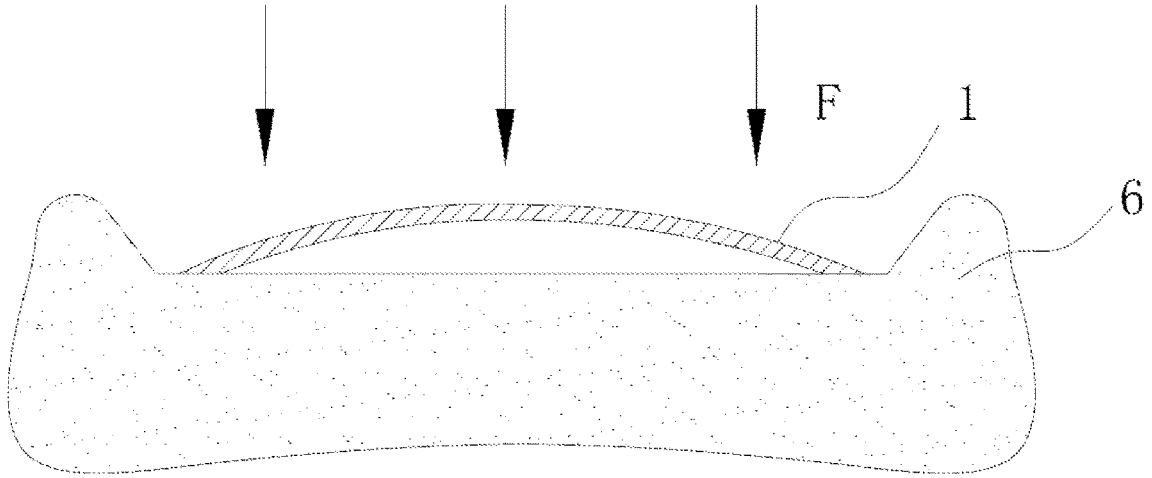
FIG. 13 is a schematic diagram of a cross-sectional view of Embodiment 5.

As shown in FIG. 13, the space between the support plate 1 and the shoe midsole 6 is hollowed out. The support sheet 1 is a carbon fiber plate, and the two sides of the carbon fiber plate have different bending degrees, the upper surface downward bending degree is a, and the lower surface upward bending degree is b, then a>b. The carbon fiber plate is installed in the correct direction, making it easier to bend downward, which is conducive to absorbing impact and increasing the effect of shock absorption and energy return.

Figure 14:
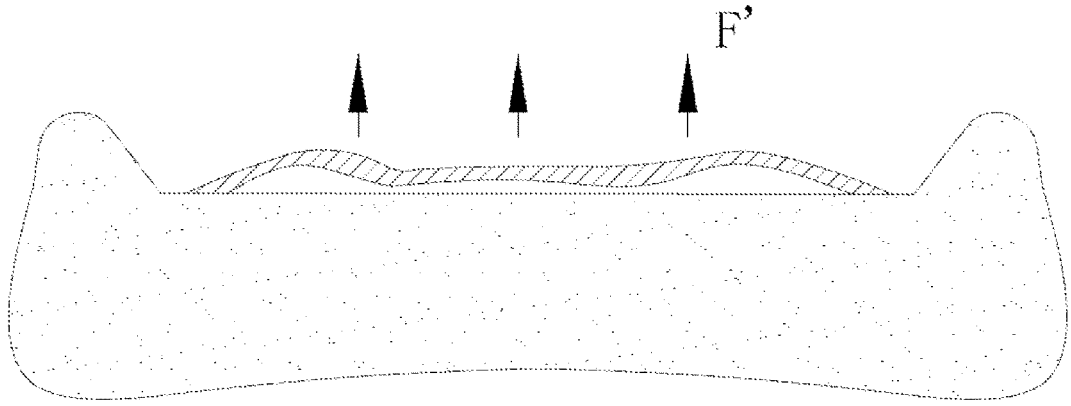
FIG. 14 is a schematic diagram of the deformation state of the support piece under pressure in FIG. 13.

As shown in FIGS. 13 and 14, when the metatarsophalangeal joint is plantarflexed, the support piece is bent by the force F, and energy is stored in the support piece 1, which has a greater tendency of deformation recovery (rebound force F'), which facilitates the release of energy from the support piece 1. At the same time, the metatarsophalangeal joint receives less resistance when doing plantarflexion, and good plantarflexion can provide a stable working environment for the ankle joint, which is conducive to improving longitudinal jump performance.

Embodiment 6

This embodiment discloses a shoe sole comprising the support structure of Embodiment 1. The support plate 1 is bonded or integrally formed above the shoe midsole in a direction where the downward bend is greater than the upward bend, or is bonded or integrally formed between the shoe midsole and the shoe outsole, or is embedded inside the shoe midsole.

Figure 15:
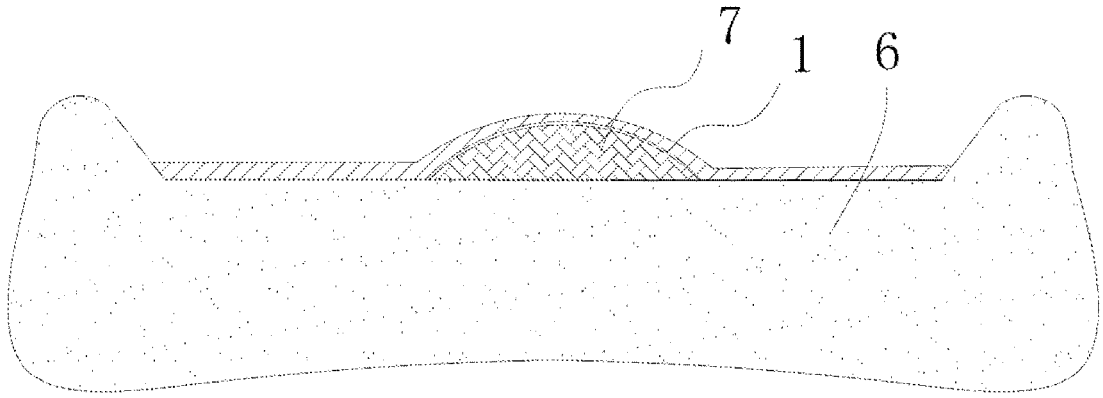
FIG. 15 is a schematic diagram of a cross-sectional view of Embodiment 6.

As shown in FIG. 15, the shoe midsole 6 is provided with a bottom convexity 7 corresponding to the position of the raised arcuate section of the support piece 1. The raised arcuate section of the support piece 1 is supported by the fitting of the sole convex 7. The bottom convex 7 is made of EVA material with a resilience of 55-70%, i.e. the bottom convex is a high resilient EVA material, and the high resilient bottom convex can facilitate the elastic deformation of the support piece.

Embodiment 7

This embodiment discloses a shoe sole, including the support structure of Embodiment 2. The support structure is bonded or integrally formed on the upper surface of the shoe midsole, or bonded or integrally formed between the shoe midsole and the shoe outsole, or embedded inside the shoe midsole.

As shown in FIGS. 7 and 8, the shoe midsole 6 is provided with a recess 8 corresponding to the position of the recessed arcuate section of the support piece 1. The midsole of the shoe in the recessed area is selected to be made of a highly resilient EVA material with a resilience rate of 55-70%.

Embodiment 8

This embodiment discloses a shoe sole comprising the support structure of embodiment three or embodiment four.

Figure 16:
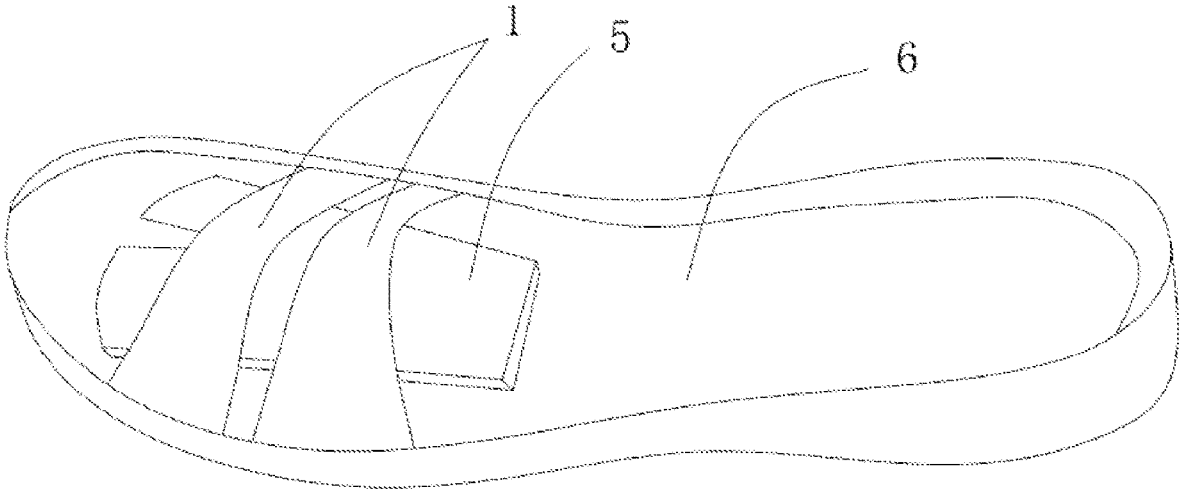
FIG. 16 is a schematic diagram of the structure of Embodiment 8.

As shown in FIG. 16, the support plate 5 is laid out along the length of the sole, the support piece 1 is set two pieces along the width of the sole, the support piece 1 is located on the support plate 5, and the support plate 5 is hollowed out between the support plate 5 and the support piece 1 (shown in FIG. 10), or the support plate 5 is filled with sole material between the support piece 1 (shown in FIG. 12), such as a high resilient EVA material with a resilience rate of 55-70%.

Embodiment 9

This embodiment discloses an athletic shoe comprising the sole of any one of embodiments 5 to 8.

The above description is only a better specific implementation of the utility model, but the scope of protection of the utility model is not limited to this, any changes or replacements that can be easily thought of by a person skilled in the art within the technical scope disclosed by the utility model shall be covered by the scope of protection of the utility model.

What is claimed is:

1. A shoe sole, characterized in that: comprising a support structure, comprising:

a support piece (1) with elasticity, wherein the support piece (1) is provided at a forefoot or/and arch position of the shoe sole and is laid out along a width direction of the sole, the support piece (1) is provided with a number of raised arc sections (2) or/and concave arc sections (4) along the width direction of the sole;

the support structure being provided on an upper surface of a shoe midsole (6) of the shoe sole.

2. The shoe sole as claimed in claim 1, characterized in that: the upper surface of the shoe midsole (6) is provided with a bottom convex (7) corresponding to a position of the raised arc section (2).

3. The shoe sole as claimed in claim 2, characterized in that: the material of the bottom convex (7) or groove (8) part is EVA material with a resilience rate of 55-70%.

4. A sports shoe, characterized in that: the sports shoe comprises the shoe sole of claim 1.

5. The shoe sole as claimed in claim 1, characterized in that: the upper surface of the shoe midsole (6) is provided with a recess (8) corresponding to a position of the concave arc section (4).

* * * * *